United States Patent [19]

Martens

[11] 4,125,348

[45] Nov. 14, 1978

[54] SLIP FORMER WITH KEYWAY FORMING ASSEMBLIES

[75] Inventor: Ernst Martens, Winnipeg, Canada

[73] Assignee: Spiroll Corporation Ltd., Winnipeg, Canada

[21] Appl. No.: 810,427

[22] Filed: Jun. 27, 1977

[30] Foreign Application Priority Data

Jul. 9, 1976 [GB] United Kingdom ..... 28645/76

[51] Int. Cl.[2] ..... B28B 13/04

[52] U.S. Cl. ..... 425/64; 425/385; 425/432

[58] Field of Search ..... 425/63–65, 425/219–220, 432, 456, 385, 374

[56] References Cited

U.S. PATENT DOCUMENTS

| | | | |
|---|---|---|---|
| 1,632,317 | 6/1927 | Schlegel | 425/374 |
| 3,740,176 | 6/1973 | Nilsson | 425/64 |
| 3,781,154 | 12/1973 | Herbert et al. | 425/64 |

FOREIGN PATENT DOCUMENTS

| | | | |
|---|---|---|---|
| 507,446 | 4/1976 | U.S.S.R. | 425/385 |

*Primary Examiner*—J. Howard Flint, Jr.
*Assistant Examiner*—John McQuade
*Attorney, Agent, or Firm*—Stanley G. Ade

[57] ABSTRACT

A pair of cleat forming wheels are journalled within a frame on each side of the packing chamber of an extruding type slab forming machine, to produce shear keyway recesses in the side walls of the slab as it is formed. The wheels are connected together for rotation in the same direction by an idler gear or chain sprocket connection. The teeth on the rear or following wheel are slightly smaller than the teeth on the leading or forming wheel so that the teeth on the rear wheel finish off the forming of the recesses without damaging same. Automatic self-alignment of the teeth of the rear wheel with the recesses is provided by an adjustable slip clutch between the rear wheel and the drive connection from the leading wheel.

15 Claims, 9 Drawing Figures

SLIP FORMER WITH KEYWAY FORMING ASSEMBLIES

BACKGROUND OF THE INVENTION

This invention relates to improvements in devices for forming shear keyways on the sides of extruded slabs formed on a continuous basis on an extruding type machine.

U.S. Pat. No. 3,740,176, which is made of record in this application, illustrates a machine which forms shear keyways in the form of indentations in the sides of the slabs, by means of an endless flexible belt extending through the side walls adjacent the packing chamber and indenting the plastic concrete as it is being formed and compressed.

When the slabs are placed in side by side relationship, grout is forced between the slabs and fills the keyways thus bonding the slabs together and preventing relative longitudinal movement between adjacent slabs.

Unfortunately, it has been found that the further compaction and treatment of the concrete as the slab is formed, tends to distort these shear keyways which are formed in the sides of the slab thus lessening the efficiency thereof.

SUMMARY OF THE INVENTION

The present invention overcomes these disadvantages by providing in one embodiment, a pair of wheels connected by an idling gear so that they are synchronized, the front of said pair of wheels having cleats to form the shear keyway indentations and the rear of said wheels having similar cleats but of a slightly smaller dimension so that the formed keyway recesses are shaped and cleaned so that they hold their original shape.

Another embodiment connects the wheels together by means of sprockets and a chain extending around the sprockets.

The main object of the invention is therefore to provide a means to form shear keyway recesses on each side of an extruded slab as the slab is formed, and to ensure that these recesses maintain their shape and configuration as the slab is being formed.

One aspect of the invention is to provide in an extrusion type slab forming machine running on a pallet and including a source of power, a concrete receiving hopper, a forming and compacting chamber below the hopper defined by a horizontal top plate, apertured vertical side plates and the pallet and a slab outlet at the rear end of said chamber from which the slab extrudes as it is formed, urging the machine along the pallet in front of the slab, the slab including substantially vertical side walls; shear keyway recess forming assemblies on each side plate of the forming and compacting chamber, each of said assemblies including a frame, a leading wheel journalled for rotation in a substantially horizontal plane within said frame, a plurality of spaced shear keyway recess forming projections around the periphery of said wheel engaging through said aperture in said side plate and engaging the side wall of the forming slab within said chamber, a rear wheel journalled for rotation in a substantially horizontal plane within said frame, a plurality of spaced shear keyway recess finishing projections around the periphery of said wheel engaging through said aperture in said side plate and having a similar configuration to the projections of said leading wheel, said projections of said finishing wheel engaging the shear keyway recesses formed by said leading wheel, means for journalling said wheels within said frame, and means interconnecting said wheels whereby the rotation of said leading wheel by engagement with said wall, causes rotation of said rear wheel in the same direction.

Another aspect of the invention may incorporate a slip clutch assembly between the rear wheel and the shaft so that it can align automatically with the indentations formed by the front wheel.

With the foregoing objects in view and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
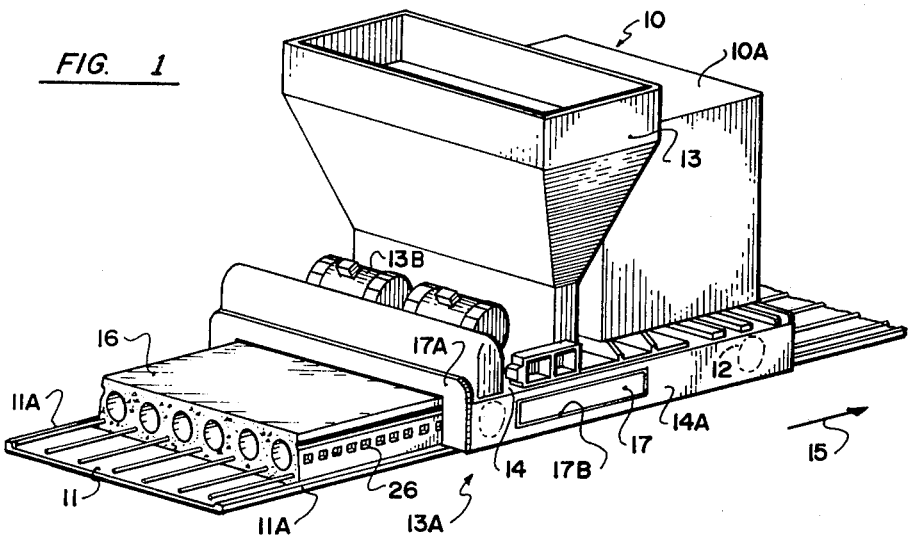
FIG. 1 is an isometric view of a typical machine used to extrude concrete slabs.

Proceeding therefore to describe the invention in detail, reference should first be made to FIG. 1 in which 10 illustrates generally, an extruding machine similar to that illustrated and described in the above identified U.S. patent.

It consists of a source of power and the various gearing contained within a casing 10A, a pallet assembly 11 upon which the machine runs and extrudes the slab therebehind, the formed slab being indicated by reference character 16, a concrete hopper 13 to feed the concrete into the packing chamber 13A which shapes and moulds the slab and forms the longitudinal apertures therethrough, and packing vibrators 13B which assist in the compaction and flow of the concrete around the augers (not illustrated) contained within the assembly.

Reference character 15 illustrates the direction of travel of the machine along the pallet with the slab 16 being extruded therebehind and rollers 12 shown in phantom, run upon the side rails 11A forming the boundaries of the pallet 11.

The weight of the slab upon the pallet causes the extrusion of the slab to push or propel the machine along the rails 11A.

Figure 2:
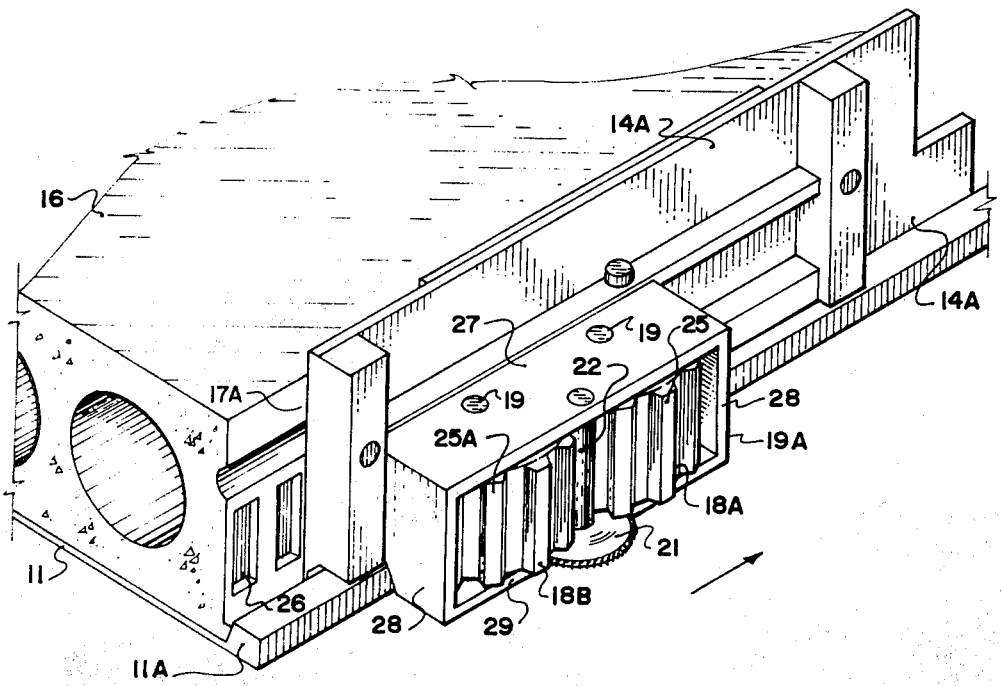
FIG. 2 is a fragmentary isometric view of one embodiment of the device in situ with part of the formed slab illustrated.
Figure 3:
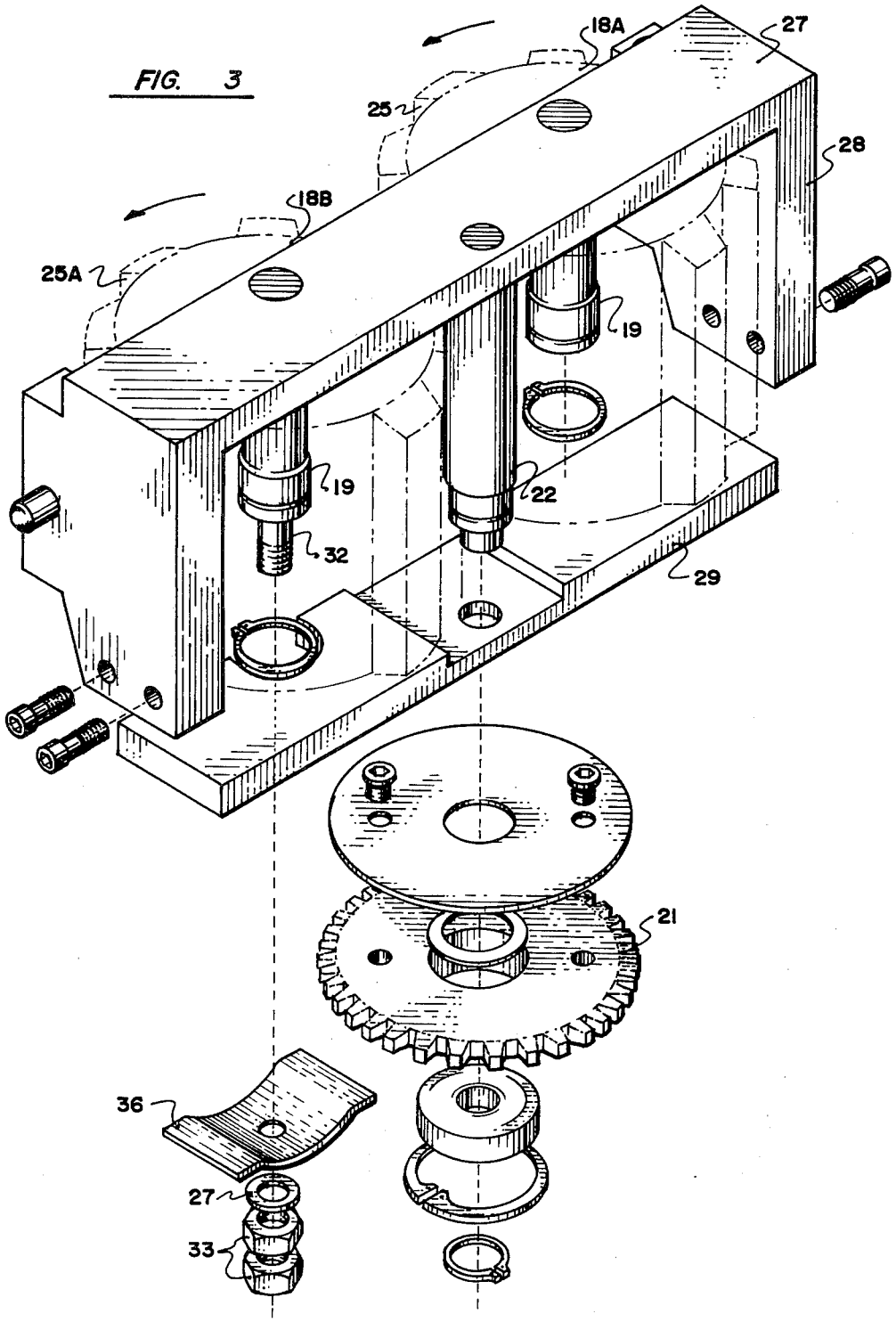
FIG. 3 is an exploded isometric view of the device per se.
Figure 4:
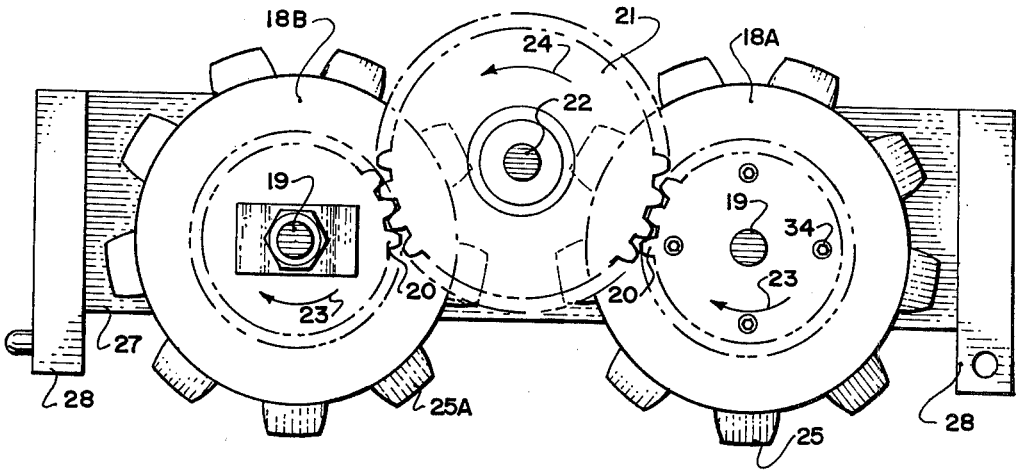
FIG. 4 is an underside view of the gear portion of the device.
Figure 5:
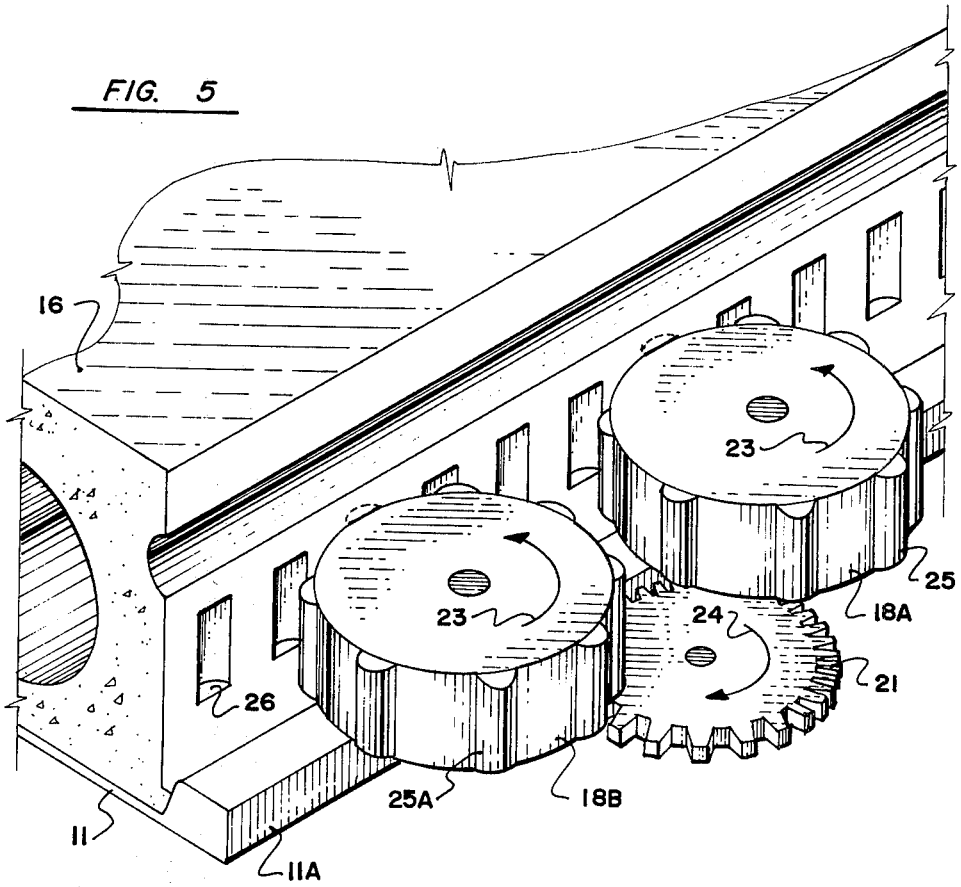
FIG. 5 is a schematic isometric view of the device engaged with the side of a slab being formed and showing one variation of the shape of the identations.
Figure 6:
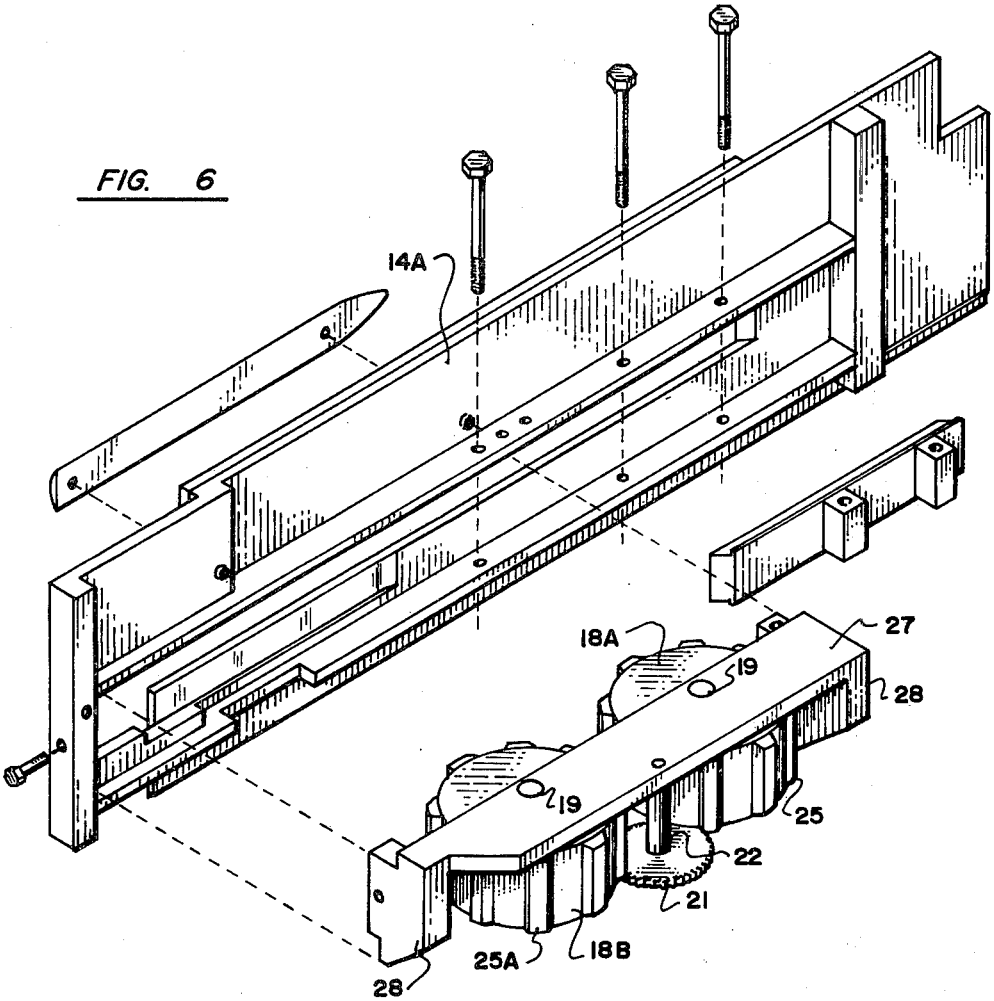
FIG. 6 is an exploded isometric view of one embodiment of the device partially assembled.

The moulding and packing chamber includes a top plate 14 with a pair of side plates 14A extending downwardly therefrom which, together with the pallet, defines the final shape of the slab 16 and the mechanism illustrated schematically in FIG. 2, is situated approximately in the location indicated by reference character 17 in FIG. 1.

Reference character 17A in FIGS. 1 and 2, illustrate the rear end of the packing chamber with the machine moving in the direction of arrow 15 extruding the block 16 therebehind.

Extending through an aperture 17B in each side plate 14A (one of which only is shown in the drawings) is a pair of cleat carrying wheels 18A and 18B journalled freely upon spindles 19 which are supported in a box-like framework 19A in the usual way.

These cleat carrying wheels also have gears 20 secured thereto meshing with an idler gear 21 journalled for free rotation upon a spindle 22 also carried within the framework.

Reference character 23 illustrates the direction of travel of the wheels 18 and reference character 24 shows the direction of travel of the idler wheel 21.

Cleats or projections 25 are formed on the periphery of the front wheels specifically designated 18A and the shape of these projections causes primary indentations or shear keyway recesses to be formed within the side of the concrete mass forming the slab 16.

Projections 25A, on the rear wheels specifically designated 18B, are slightly smaller in configuration and clean up these recesses so that they retain their shape and configuration and these recesses are illustrated by reference character 26 in the drawing.

When such recesses are formed in concrete being compressed within the packing chamber, the dimensions of the recesses decrease slightly between the forming position adjacent wheel 18A and the position adjacent wheel 18B. This means that if the cleats on the rear wheels 18B are the same size as the cleats on the front wheels 18A, then the recesses or keyways 26 become damaged.

The spacing of the projections 25 and 25A around the periphery of the wheels 18A and 18B, is such that the projections 25A engage the recesses formed by projections 25 and the rotation of the two wheels is, of course, synchronized by the engagement of the idler gear 21 with gears 20.

The action of the extruding machine which moves along the rails leaving the slab 16 upon the pallet, provides the rotation to the wheels so that a source of power is not necessary for these wheels.

The use of this assembly has been found to produce clean cut and accurately formed shear keyway recesses 26 and prevent same from being distorted due to the compacting action of the plastic concrete as it is extruded behind the machine. The configurations of the projections and hence the recesses can be varied as desired. In some of the claims, this relationship is referred to as the wheel operatively engaging against said shoulder.

As the concrete leaves the hopper 13, and enters the beginning of the forming and compaction chamber 13A, it starts to decompress by the augers (not illustrated) and at the same time the leading wheel 18A forms the shear keyway recesses 26. However, by the time the mass of concrete carrying the recesses, reaches the rear or finishing wheel 18B, it has been compacted further so that the spacing between adjacent recesses 26 is slightly less. When carried over a length of slab, the rear wheel 18B therefore becomes misaligned with the recesses with subsequent damage occurring to the recesses.

In order to prevent this, I have provided a slip clutch assembly between the rear wheel 18B and the means interconnecting this rear wheel with the front wheel 18A.

Figure 7:
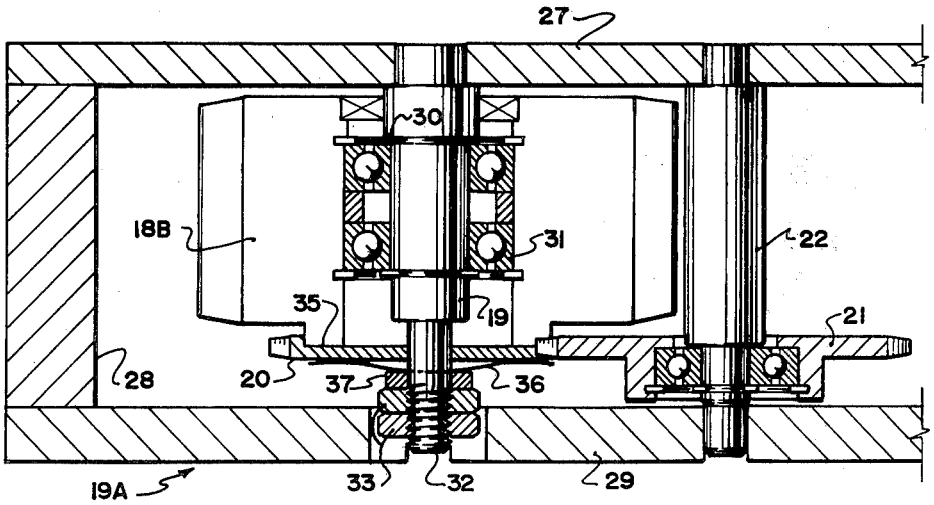
FIG. 7 is a fragmentary partially sectioned plan view of one of the wheels and idler showing the slip clutch assembly.

Dealing first with the embodiment illustrated in FIG. 7, the spindle 19 is secured to the upper plate 27 of the framework 19A. This framework includes the upper frame and a pair of end plates 28 and a lower plate 29.

The spindles 19 are shouldered as at 30 adjacent the ends by which they are secured to the plate 27 and the wheels 18A and 18B are mounted upon bearings 31 secured to the spindle 19, with the shoulder 30 engaging against one of the bearings 31 as clearly shown.

The distal end 32 of the spindle is screw threaded and nuts 33 engage this end.

The gear 20 engages over the end 32 of the spindle and is bolted to the leading wheel 18A by means of set screws 34.

However, the gear 20 which is connected to the rear wheel 18B freely engages the spindle portion 32 and is in interfacial relationship with one face 35 of the wheel 18B.

Spring pressure means in the form of an apertured bow spring 36 engages over the spindle portion 32 and against the other face of the gear 20 with a spacer washer 37 being situated between the nuts 33 and this bow spring so that by adjusting the position of nuts 33, the bow spring increases or decreases the frictional engagement of the gear with the wheel 18B.

This still enables the idler gear 21 to drive the rear wheel 18B but permits the engagement of the projections or cleats 25A to automatically align and engage accurately, the shear keyway recesses 26 so that misalignment does not occur.

Figure 8:
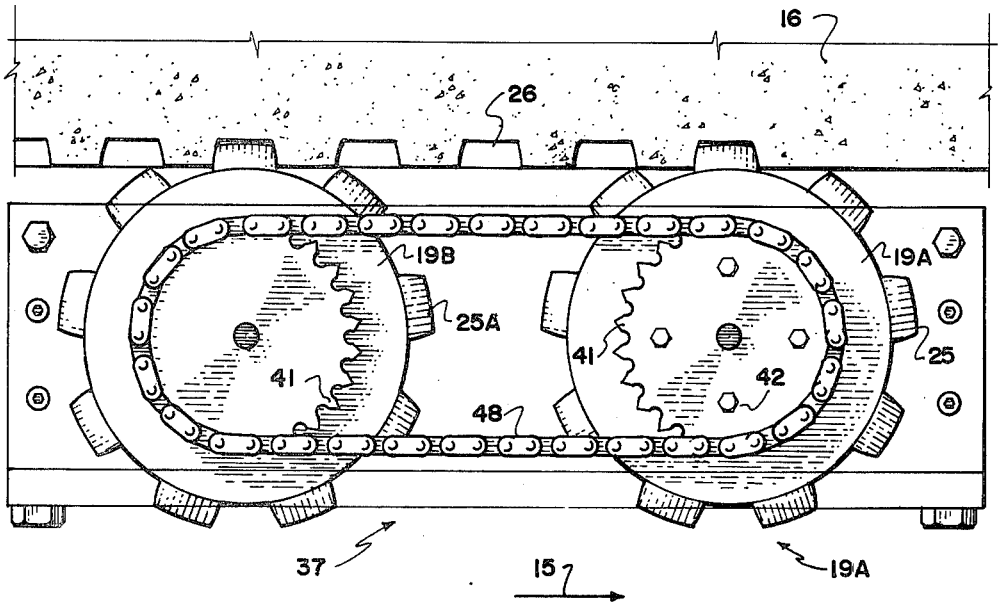
FIG. 8 is a partially schematic top plan view of the preferred embodiment.
Figure 9:
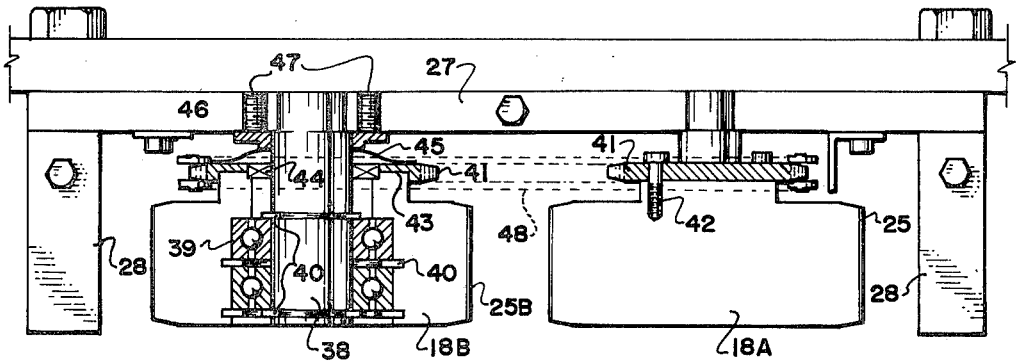
FIG. 9 is a partially sectioned fragmentary side elevation of the preferred embodiment.

The preferred embodiment is shown in FIG. 8 and 9 in which the means interconnecting the front and rear wheels 18A and 18B, takes the form of a sprocket and chain assembly collectively designated 37.

In this embodiment, the spindle identified by reference character 38, is secured by one end thereof to the top plate 27 of the framework 19A by conventional means.

The wheels 18A and 18B are mounted for free rotation upon the spindle 38 by means of bearings 39 and prevented from endwise movement upon the spindle by split rings 40 as shown operatively engaging between the wheels and the bearings and shaft.

A sprocket wheel 41 freely engages the shaft 38 between the wheels 18A and 18B and in the case of wheel **18*a* it is bolted to this wheel by means of set bolts or screws 42**.

In the case of wheel 18B, the sprocket is in interfacial relationship with the inner face 43 of the wheel 18B and is mounted upon a bearing 44 secured to shaft 38.

Spring pressure means in the form of a bow spring 45 is secured to an adjuster 46 surrounding shaft 38 adjacent the upper end thereof and bears against the opposite face of the sprocket 41 with the pressure of the spring being adjusted by means of set screws 47 engaged through the upper plate 27 and engaging the adjuster 46 as clearly shown.

A sprocket chain 48 engages around the sprockets 41 and connects the front and rear wheels 18A and 18B together with the slip clutch assembly permitting automatic alignment of the projections 25A with the shear keyway recesses 26. It should be understood that this slip clutch assembly operates in a manner similar to that described with reference to FIG. 7.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. In an extrusion type slab forming machine mounted for movement on a pallet and including a source of power on said machine for operating same, a concrete receiving hopper, a forming and compacting chamber below the hopper defined by a horizontal top plate, apertured vertical side plates and the pallet, and a slab outlet at the rear end of said chamber from which the slab extrudes as it is formed, urging the machine along the pallet in front of the slab, the slab including substantially vertical side walls; shear keyway recess forming assemblies on each side plate of the forming and compacting chamber, each of said assemblies including a frame, a leading wheel journalled for rotation about a vertical axis within said frame, a plurality of spaced shear keyway recess forming projections around the periphery of said wheel engaging through said aperture in said side plate and adapted to engage the side wall of the forming slab within said chamber, a rear wheel journalled for rotation about a vertical axis within said frame, a plurality of spaced shear keyway recess finishing projections around the periphery of said rear wheel engaging through said aperture in said side plate and having a similar configuration to the projections of said leading wheel, said projections of said rear wheel adapted to engage the shear keyway recesses formed by said leading wheel, means for journalling said wheels within said frame, and means interconnecting said wheels whereby the rotation of said leading wheel by engagement with said slab side wall, causes rotation of said rear wheel in the same direction, the dimensions of the projections of said rear wheel being slightly less than the dimensions of the projections of said leading wheel.

2. The machine according to claim 1 in which said means interconnecting said wheels includes a gear operatively connected to each of said wheels and an idler gear journalled for rotation within said frame and engaging said gear on each of said wheels.

3. The machine according to claim 1 in which said means interconnecting said wheels includes a chain sprocket operatively connected to each of said wheels and a sprocket chain operatively extending around said sprockets.

4. The machine according to claim 2 in which said means for journalling said rear wheel within said frame includes a spindle supported at one end thereof within said frame, a shoulder on said spindle adjacent said one end, said rear wheel freely engaging said spindle and operatively engaging against said shoulder, said rear wheel gear freely engaging said spindle and being in interfacial relationship with the outer face of said rear wheel, spring pressure means urging said gear into frictional engagement with said outer face and means to adjust the spring pressure means and hence said frictional engagement.

5. The machine according to claim 3 in which said means for journalling said rear wheel within said frame includes a spindle supported at one end thereof within said frame, means securing said rear wheel for free rotation upon said spindle and against endwise movement thereon, said rear wheel sprocket freely engaging said spindle and being in interfacial frictional engagement with one face of said rear wheel, pressure means urging said rear wheel sprocket into frictional engagement with said one face and means to adjust the spring pressure and hence the said frictional engagement.

6. In an extrusion type slab forming machine mounted for movement on a pallet and including a source of power on said machine for operating same, a concrete receiving hopper, a forming and compacting chamber below the hopper defined by a horizontal top plate, apertured vertical side plates and the pallet, and a slab outlet at the rear end of said chamber from which the slab extrudes as it is formed, urging the machine along the pallet in front of the slab, the slab including substantially vertical side walls; shear keyway recess forming assemblies on each side plate of the forming and compacting chamber, each of said assemblies including a frame, a leading wheel journalled for rotation about a vertical axis within said frame, a plurality of spaced shear keyway recess forming projections around the periphery of said wheel engaging through said aperture in said side plate and adapted to engage the side wall of the forming slab within said chamber, a rear wheel journalled for rotation about a vertical axis within said frame, a plurality of spaced shear keyway recess finishing projections around the periphery of said rear wheel engaging through said aperture in said side plate and having a similar configuration to the projections of said leading wheel, said projections of said rear wheel adapted to engage the shear keyway recesses formed by said leading wheel, means for journalling said wheels within said frame, means interconnecting said wheels whereby the rotation of said leading wheel by engagement with said slideside wall, causes rotation of said rear wheel in the same direction, and adjustable slip clutch means operatively connected between said rear wheel and said means interconnecting said wheels, whereby said rear wheel automatically synchronizes the engagement of its said projections with said shear keyway recesses formed by said leading wheel.

7. The machine according to claim 6 in which said means interconnecting said wheels includes a gear operatively connected to each of said wheels and an idler gear journalled for rotation within said frame and engaging said gear on each of said wheels.

8. The machine according to claim 6 in which said means interconnecting said wheels includes a chain sprocket operatively connected to each of said wheels and a sprocket chain operatively extending around said sprockets.

9. The machine according to claim 7 in which said means for journalling said rear wheel within said frame includes a spindle supported at one end thereof within said frame, a shoulder on said spindle adjacent said one end, said rear wheel freely engaging said spindle and operatively engaging against said shoulder, said gear freely engaging said spindle and being in interfacial relationship with the outer face of said rear wheel, spring pressure means urging said rear wheel gear into frictional engagement with said outer face and means to adjust the spring pressure means and hence said frictional engagement.

10. The machine according to claim 8 in which said means for journalling said rear wheel within said frame includes a spindle supported at one end thereof within said frame, means securing said rear wheel for free rotation upon said spindle and against endwise movement thereon, said rear wheel sprocket freely engaging said spindle and being in interfacial frictional engagement with one free of said rear wheel, pressure means urging said rear wheel sprocket into frictional engagement with said one face and means to adjust the spring pressure and hence the said frictional engagement.

11. The machine according to claim 6 in which the dimensions of the projections of said rear wheel are slightly less than the dimensions of the projections of said leading wheel.

12. The machine according to claim 7 in which the dimensions of the projections of said rear wheel are slightly less than the dimensions of the projections of said leading wheel.

13. The machine according to claim 8 in which the dimensions of the projections of said rear wheel are slightly less than the dimensions of the projections of said leading wheel.

14. The machine according to claim 12 in which said means for journalling said rear wheel within said frame includes a spindle supported at one end thereof within said frame, a shoulder on said spindle adjacent said one end, said rear wheel freely engaging said spindle and operatively engaging against said shoulder, said rear wheel gear freely engaging said spindle and being in interfacial relationship with the outer face of said wheel, spring pressure means urging said rear wheel gear into frictional engagement with said outer face and means to adjust the spring pressure means and hence said frictional engagement.

15. The machine according to claim 13 in which said means for journalling said rear wheel within said frame includes a spindle supported at one end thereof within said frame, means securing said rear wheel for free rotation upon said spindle and against endwise movement thereon, said rear wheel sprocket freely engaging said spindle and being in interfacial frictional engagement with one face of said rear wheel, pressure means urging said rear wheel sprocket into frictional engagement with said one face and means to adjust the spring pressure and hence the said frictional engagement.

* * * * *